United States Patent [19]

Mieno et al.

[11] Patent Number: 4,723,521

[45] Date of Patent: Feb. 9, 1988

[54] AIR/FUEL RATIO CONTROL SYSTEM FOR AN INTERNAL COMBUSTION ENGINE

[75] Inventors: Toshiyuki Mieno; Toyohei Nakajima; Yasushi Okada; Nobuyuki Oono, all of Wako, Japan

[73] Assignee: Honda Giken Kogyo Kabushiki Kaisha, Tokyo, Japan

[21] Appl. No.: 19,160

[22] Filed: Feb. 26, 1987

[30] Foreign Application Priority Data

Feb. 26, 1986 [JP] Japan ..... 61-041266

[51] Int. Cl.[4] ..... F02M 51/00; F02D 41/12

[52] U.S. Cl. ..... 123/489; 123/325; 123/493; 204/426

[58] Field of Search ..... 123/325, 440, 489, 493, 123/589; 204/424, 425, 426, 427

[56] References Cited

U.S. PATENT DOCUMENTS 4,391,243 7/1983 Bessho ..... 123/493 X
4,550,703 11/1985 Ootuka et al. ..... 123/493 X
4,568,443 2/1986 Asayama et al. ..... 204/426 X
4,594,139 6/1986 Asayama et al. ..... 204/425 X
4,648,370 3/1987 Kobayashi et al. ..... 123/325 X
4,658,790 4/1987 Kitahara ..... 123/440

*Primary Examiner*—Willis R. Wolfe
*Attorney, Agent, or Firm*—Pollock, VandeSande and Priddy

[57] ABSTRACT

An air/fuel ratio control system for an internal combustion engine includes an oxygen concentration sensor for sensing the oxygen concentration in the exhaust gas of the engine, and a correction value setting device which determines a correction value corresponding to an output signal of the oxygen concentration sensor obtained when the fuel cut operation of the engine has continued for more than a predetermined time period. The output signal of the oxygen concentration sensor is corrected by the correction value during the engine operation other than the fuel cut operation.

5 Claims, 10 Drawing Figures

| FIG. 7A | FIG. 7B |
|---|---|

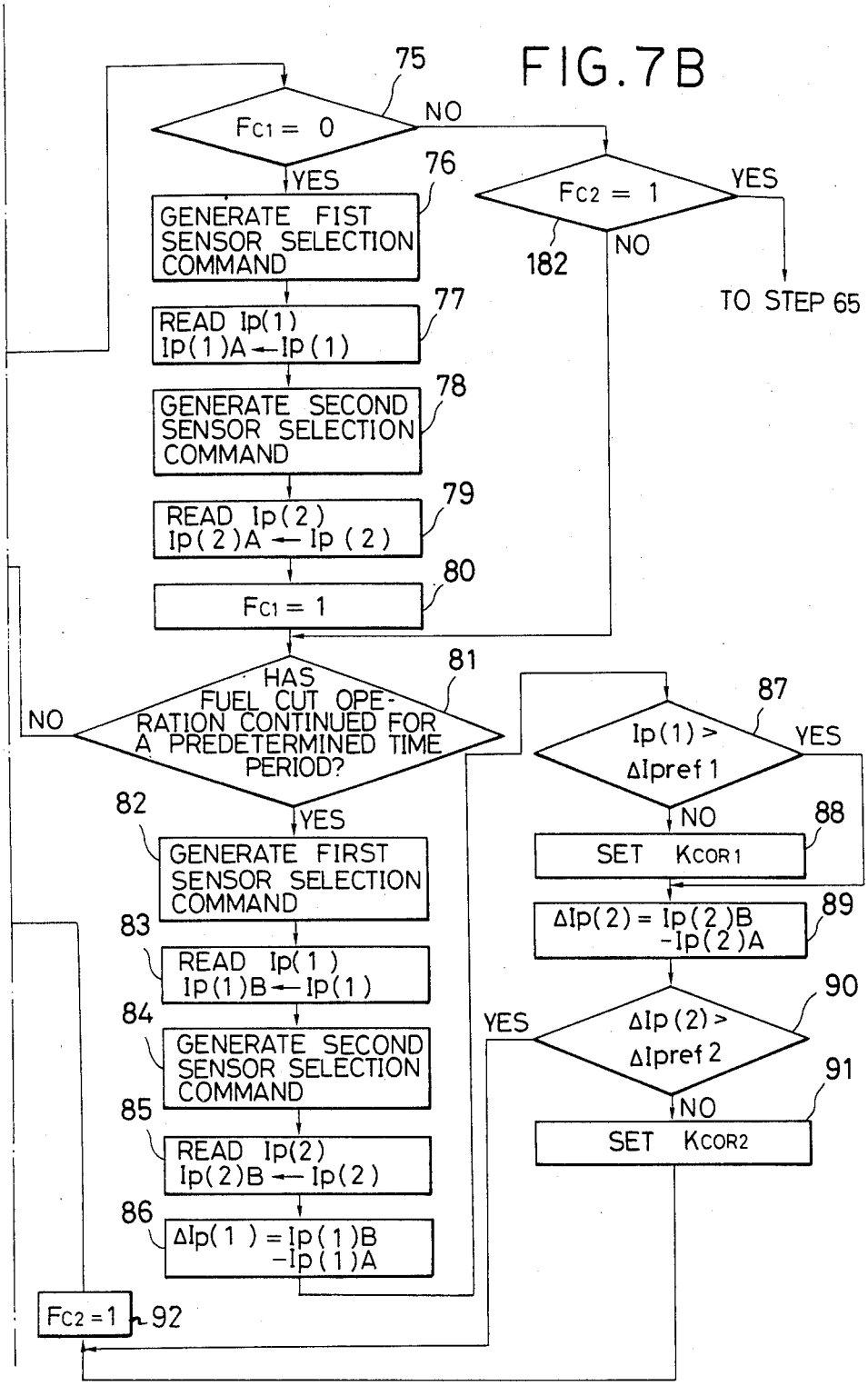
FIG. 7B
75
Fc1 = 0
NO
YES
76
GENERATE FIST SENSOR SELECTION COMMAND
77
READ Ip(1)
Ip(1)A ← Ip(1)
78
GENERATE SECOND SENSOR SELECTION COMMAND
79
READ Ip(2)
Ip(2)A ← Ip(2)
80
Fc1 = 1
Fc2 = 1
YES
NO
182
TO STEP 65
81
HAS FUEL CUT OPERATION CONTINUED FOR A PREDETERMINED TIME PERIOD?
NO
YES
82
GENERATE FIRST SENSOR SELECTION COMMAND
83
READ Ip(1)
Ip(1)B ← Ip(1)
84
GENERATE SECOND SENSOR SELECTION COMMAND
85
READ Ip(2)
Ip(2)B ← Ip(2)
86
ΔIp(1) = Ip(1)B − Ip(1)A
Fc2 = 1
92
87
Ip(1) > ΔIpref 1
YES
NO
88
SET KCOR1
89
ΔIp(2) = Ip(2)B − Ip(2)A
90
ΔIp(2) > ΔIpref 2
YES
NO
91
SET KCOR2

AIR/FUEL RATIO CONTROL SYSTEM FOR AN INTERNAL COMBUSTION ENGINE

BACKGROUND OF THE INVENTION

1. Field of the Invention

The present invention relates to an air/fuel ratio control system for an internal combustion engine, and more particularly to an air/fuel ratio control system which uses an oxygen concentration sensor for sensing an oxygen concentration in the exhaust gas of the internal combustion engine.

2. Description of Background Information

In order to accelerate the purification of the exhaust gas and to improve the fuel economy of an internal combustion engine, a feedback type air/fuel ratio control system is used, in which oxygen concentration in the exhaust gas is detected and air/fuel ratio of the mixture supplied to the engine is controlled to a target air/fuel ratio by a feedback control operation in accordance with an output signal of the oxygen concentration sensor.

As an oxygen concentration sensor for use in such an air/fuel ratio control system, there is a type which is capable of producing an output signal whose level is proportional to the oxygen concentration in the exhaust gas of the engine. For example, a critical current type oxygen concentration sensor which includes a flat oxygen ion conductive solid electrolyte member provided with a pair of electrodes on the main surfaces thereof, and the surface of one of the electrodes forms a part of a gas retaining chamber which gas retaining chamber communicates with a flow of measuring gas such as the exhaust gas through a communication hole, is disclosed in Japanese Patent Application laid open No. 52-72286. In the case of this oxygen concentration sensor, the oxygen ion conductive solid electrolyte member and the electrode pair serve as an oxygen pump element. If a current is supplied across the electrodes in such a manner that the electrodes facing the gas retaining chamber operates as a negative electrode, the oxygen component of the gas in the gas retaining chamber is ionized on the surface of the negative electrode of the oxygen pump element, and migrates through the inside of the oxygen pump element to the positive electrode, where the oxygen ions are released from the surface thereof in the form of the oxygen gas.

Under this condition, the magnitude of the critical current flowing across the electrodes becomes constant irrespectively of the applied voltage, and varies substantially in proportion to the oxygen concentration in the measuring gas. Therefore, by detecting the critical current value, the oxygen concentration in the measuring gas can be measured. However, if the air/fuel ratio is controlled by using this oxygen concentration sensor, the output signal of the oxygen concentration sensor becomes proportional to the oxygen concentration only when the air/fuel ratio of the mixture supplied to the engine is leaner than the stoichiometric air/fuel ratio. Therefore, an air/fuel ratio control operation using a target air/fuel ratio which is set in a rich range was not possible. As an example of oxygen concentration sensor capable of producing an output signal which is proportional to the oxygen concentration in the exhaust gas in both of the lean and rich ranges, an oxygen concentration sensor which includes a pair of flat oxygen ion conductive solid electrolyte members each of which is provided with a pair of electrodes, and the surface of one electrode of each solid electrolyte member forms a part of a gas retaining chamber which gas retaining chamber communicates with a flow of measuring gas through a communication hole, and the surface of the other electrode of one of two solid electrolyte members faces an atmospheric chanber, is disclosed in Japanese Patent Application laid open No. 59-192955. In this oxygen concentration sensor, one of two oxygen ion conductive solid electrolyte members and the electrode pair serve as an oxygen concentration ratio detection sensor cell element, and the other one of two oxygen ion conductive solid electrolyte members and the electrode pair serve as the oxygen pump element. By supplying a current so that the oxygen ions moves through the inside of the oxygen pump element toward the electrode located on the gas retaining chamber's side when the voltage generated across the electrodes of the oxygen concentration ratio detection sensor cell element is higher than a reference voltage, and so that the oxygen ions move through the inside of the oxygen pump element toward the electrode located on the other side of the gas retaining chamber when the voltage generated across the oxygen concentration ratio detection sensor cell element is equal to or lower than the reference voltage, the current value becomes proportional to the oxygen concentration both in the lean and rich regions.

When this oxygen concentration proportional type oxygen concentration sensor is used in an exhaust pipe of the internal combustion engine, it is recognized that the diameter of the gas introduction hole reduces gradually because of the adhesion of substances such as oxide compounds contained in the exhaust gas. If the diameter of the gas introduction hole is reduced, the output signal characteristic of the oxygen concentration sensor will be changed and a desirable output signal characteristic can not be obtained. Therefore, it becomes difficult to accurately determine the air/fuel ratio of the mixture from the output signal level of the oxygen concentration sensor. Thus, there was a problem that the change in the output signal characteristic of the oxygen concentration sensor causes a reduction of the efficiency of the purification of the exhaust gas of the engine.

OBJECT AND SUMMARY OF THE INVENTION

An object of the present invention is therefore to provide an air/fuel ratio control system for an internal combustion engine in which the air/fuel ratio of the mixture to be supplied to the engine is accurately detected by the output signal level of an oxygen concentration sensor used therein even if the diameter of the gas introduction hole is reduced by the adhesion of oxide compounds, thereby to maintain the efficiency of the exhaust gas purification.

According to the present invention, an air/fuel ratio control system for an internal combustion engine having an exhaust gas passage, comprises an oxygen concentration sensor which includes,

- a sensing part forming a gas retaing space which communicates with an inside of the exhaust gas passage through a gas diffusion restriction region, and which includes a wall of oxygen ion conductive solid electrolyte member with two pairs of electrodes, each pair of which is disposed on opposing sides of the wall of oxygen ion conductive solid electrolyte member, and
- a sensor output signal generating part for supplying a current, in response to a voltage developping across the electrodes of one pair of the two pairs of electrodes, across the electrodes of the other pair of the two pairs of electrodes, and outputting a value of the current as the sensor output signal;

a correction value setting means for setting a correction value corresponding to the sensor output signal obtained when a fuel cut operation of the engine for stopping the supply of fuel to the engine has continued for more than a predetermined time period;

a correction means for correcting the sensor output signal in accordance with the correction value during an operation of the engine other than the fuel cut operation, and generating an output signal; and an air/fuel ratio adjusting means for adjusing an air/fuel ratio of the mixture to be suppied to the engine in response to the output signal of the correction means.

In short, the air/fuel ratio control system for an internal combustion engine comprises means for setting a correction value corresponding to the level of the output signal of the oxygen concentration sensor obtained under a condition in which a fuel cut operation for stopping the supply of the fuel to the engine has continued for more than a predetermined time period, and correction means for producing a corrected output signal by correcting the output signal level of the oxygen concentration sensor on the basis of the above correction value during the periods of the engine operation other than the fuel cut operation, whereby the air/fuel ratio of the mixture to be supplied to the engine is controlled according to the output signal of the correction means.

According to another aspect of the present invention, the sensing part of the oxygen concentration sensor further includes a second gas retaining space which communicates with the gas retaining space, and which includes a second wall portion of oxygen ion conductive solid electrolyte member with two second pairs of electrodes, each second pair of which is disposed on opposing sides of the second wall portion of oxygen ion conductive solid electrolyte member, and wherein the sensor output signal generating part alternatively supplies the current, in response to a voltage developping across the electrodes of one pair of the two pairs of electrodes or the two second pairs of electrodes, across the electrodes of the other pair of the two pairs of electrodes or the two second pairs of electrodes, and outputting a value of the current as the sensor output signal.

According to a further aspect of the invention, the correction value setting means calculates the correction value on the basis of a difference between the sensor output signal obtained immediately after the start of the fuel cut operation and the sensor output signal obtained when the fuel cut operation has continued for the predetermined time period.

According to a still further aspect of the invention, the correction value setting means calculates the correctiuon value on the basis of a ratio between the sensor output signal obtained when the fuel cut operation has continued for more than the predetermined time period and a predetermined reference value.

According to a further aspect of the invention, the correction value setting means establish the correction value only when a difference between the sensor output signal obtained immediately after the start of the fuel cut operation and the sensor output signal obtained when the fuel cut operation has continued for the predetermined time period becomes equal to or smaller than a predetermined reference level.

BRIEF DESCRIPTION OF THE DRAWINGS

FIG. 5 is a diagram illustrating the juxtaposition of FIGS. 5A and 5B;

FIGS. 7A and 7B, when combined, are a flowchart illustrating the control operation in a second embodiment of the present invention; and FIG. 7 is a diagram illustrating the juxtaposition of FIGS. 7A and 7B.

DETAILED DESCRIPTION OF THE PREFERRED EMBODIMENTS

An embodiment of the present invention will be explained with reference to the accompanying drawings hereinafter.

Figure 1:
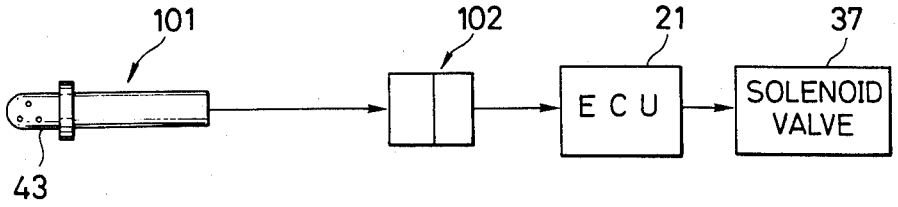
FIG. 1 is a schematic diagram illustrating the air/fuel ratio control system according to the preset invention.
Figure 2A:
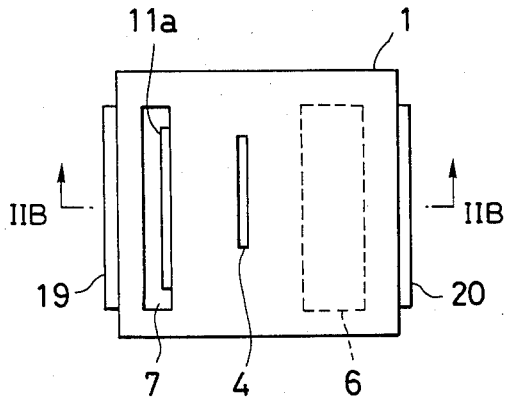
FIG. 2A is plan view illustrating a sensor unit provided in the oxygen concentration sensor body used in the system shown in FIG. 1.
Figure 2B:
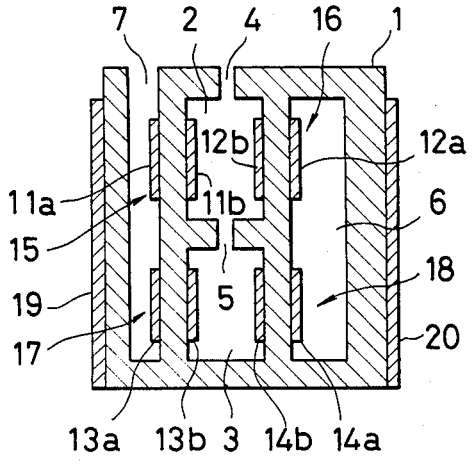
FIG. 2B is a sectional view of the oxygen concentration sensing unit taken along the line IIB—IIB of FIG. 2A.
Figure 3:
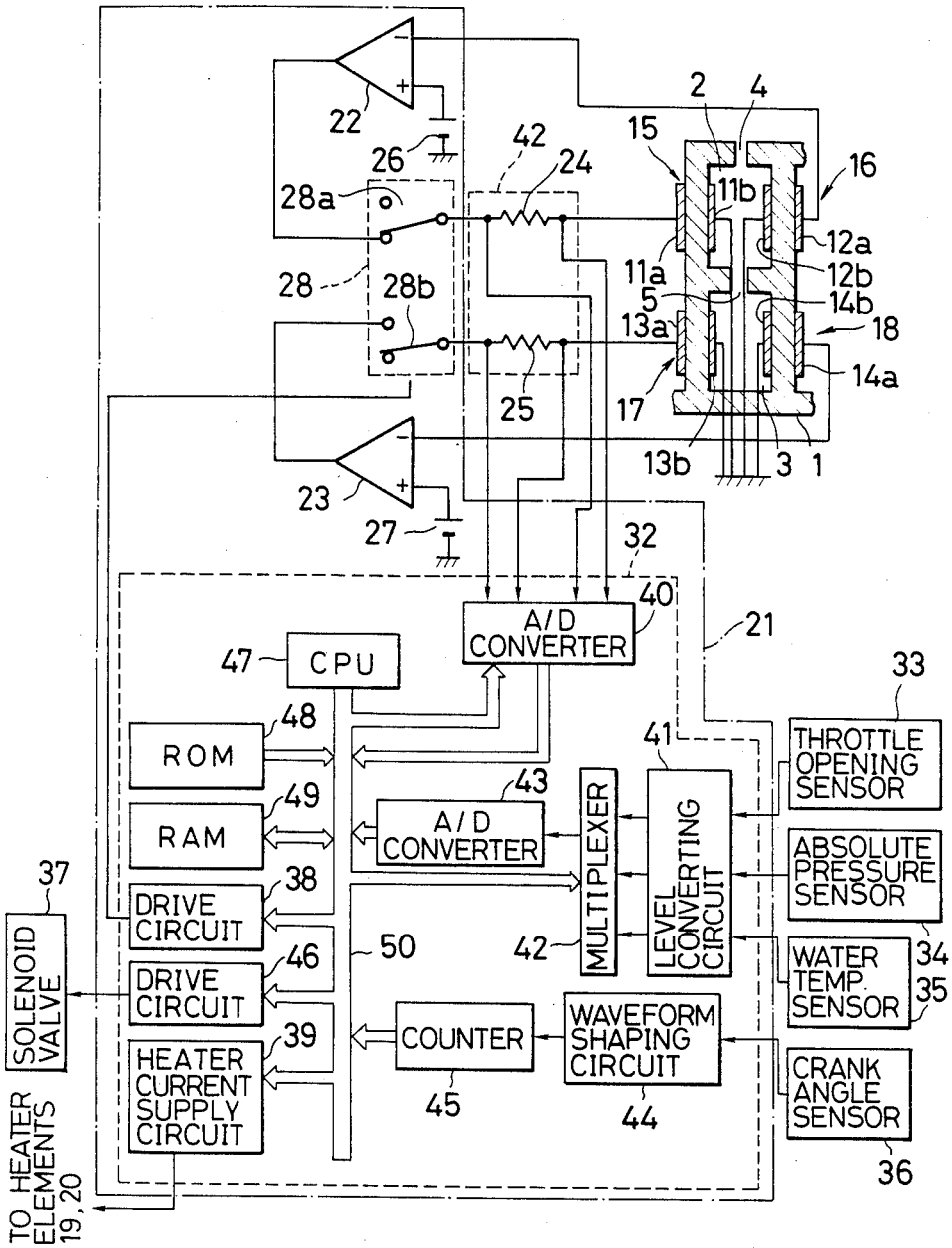
FIG. 3 is a circuit diagram showing the construction of an electronic control unit in the system shown in FIG. 1.

FIGS. 1 through 3 shows an air/fuel ratio control system as an embodiment of the present invention. In this system, an oxygen concentration sensor 101 is disposed in an exhaust pipe (not shown) of an internal combustion engine, and input and output signals of the oxygen concentration sensor 101 is connected to an ECU (electronic control unit) 21 through a connector 102. The ECU 21 drives a solenoid valve 37.

In a protection case 43 of the oxygen concentration sensor 101, there is provided an oxygen ion conductive solid electrolyte member 1 having generally cubic configuration as shown in FIGS. 2A and 2B. In the oxygen ion conductive solid electrolyte member 1, first and second gas retaining chambers 2 and 3 are provided. The first gas retaining chamber 2 leads to a gas introduction hole 4 for introducing the measuring gas, i.e. the exhaust gas of the engine, from outside of the oxygen ion conductive solid electrolyte member 1. The gas introduction hole 4 is positioned in an exhaust gas passage (not shown) of the internal combustion engine so that the exhaust gas can easily flow into the gas retaining chamber 2. In a wall between the first gas retaining chamber 2 and the second gas retaining chamber 3, there is provided a communication channel 5 so that the exhaust gas is introduced into the second gas retaining chamber 3 through the gas introduction hole 4, the first gas retaining chamber 2 and the communication channel 5. Further, the oxygen-ion conductive solid electrolyte member 1 is provided with a reference gas chamber 6 into which outside air for example is introduced, in such a manner that the reference gas chamber 6 is separated from the first and second gas retaining chambers 2 and 3 by means of a partition wall between them. In a side wall of the first and second gas retaining chambers 2 and 3, on the opposite side of the reference gas chamber 6, there is provided an electrode protection cavity 7. The wall between the first gas retaining chamber 2 and the reference gas chamber 6 and the electrode protection cavity 7, there respectively are provided a pair of electrodes 12*a* and 12*b*, and a pair of electrodes 11*a* and 11*b*. The electrodes 11*a*, 11*b*, and 12*a*, 12*b* form a first set of electrodes associated with the first gas retaining chamber 2. Similarly, the wall between the second gas retaining chamber 3 and the gas reference chamber 6, and the wall between the second gas retaining chamber 3 and the electrode protection cavity 7 are respectively provided with a pair of electrodes 14*a* and 14*b*, and a pair of electrodes 13*a* and 13*b*. The electrodes 13*a*, 13*b*, and 14*a*, 14*b* form a second set of electrodes associated with the second gas retaining chamber 3. The solid electrolyte member 1 and the pair of electrodes 11*a* and 11*b* together operate as a first oxygen pump unit 15. On the other hand, the solid electrolyte member 1 and the pair of electrodes 12*a* and 12*b* together operate as the first sensor cell unit 16. Similarly, the solid electrolyte member 1 and the pair of electrodes 13*a* and 13*b* together operate as a second oxygen pump unit 17, and the solid electrolyte member and the pair of electrodes 14*a* and 14*b* together operate as the second sensor cell unit 18. Further, heater elements 19 and 20 are respectively provided on an outer wall of the reference gas chamber 6 and an outer wall of the electrode protection cavity 7, respectively. The heater elements 19 and 20 are electrically connected in parallel with each other so as to heat the first and second oxygen pump units 15 and 17, and the first and second sensor cell units 16 and 18 equally. The heater elements 19 and 20 further have an effect to enhance the heat retaining property of the solid electrolyte member 1. The solid electrolyte member 1 is made up of a plurality of pieces, to form an integral member. In addition, the walls of the first and second gas retaining chambers 2 and 3 need not be made of the oxygen ion conductive solid electrolyte as a whole. At least portions of the wall on which the electrodes are provided must be made of the solid electrolyte.

As the oxygen ion conductive solid electrolyte, zirconium dioxide ($ZrO_2$) is suitably used, and platinium (Pt) is used as the electrodes 11*a* through 14*b*.

The first oxygen pump unit 15 and and the first sensor cell unit 16 form a first sensor, and the second oxygen pump unit 17 and the second sensor cell unit 18 form a second sensor. The first and second oxygen pump units 15 and 17, the first and second sensor cell units 16 and 18 are connected to the electronic control unit 21. As shown in FIG. 3, the electronic control unit 21 includes differential amplifiers 22 and 23, current detection resistors 24 and 25 for detecting the magnitude of the current, and sources of reference voltages 26 and 27, a switch circuit 28 and a control circuit 32. The electrode 11*a* provided on the outer surface of the first oxygen pump unit 15 is connected to an output terminal of the differential amplifier 22 through the current detection resistor 24 and a switch element 28*a* of the switch circuit 28. The electrode 11*b* provided on the inner surface of the first oxygen pump unit 15 is grounded. The electrode 12*a* provided on the outer surface of the first sensor cell unit 16 is connected to an inverting input terminal of the differential amplifier 22, and the electrode 12*b* on an inner surface of the first sensor cell unit 16 is grounded. Similarly, the electrode 13*a* provided on the outer surface of the second oxygen pump unit 17 is connected to an output terminal of the differential amplifier 23 through the current detection resistor 25, and a switch element 28*b* of the switch circuit 28. The electrode 13*b* provided on the inner surface of the second oxygen pump unit 17 is grounded. The electrode 14*a* provided on the outer surface of the second sensor cell unit 18 is connected to an inverting input terminal of the differential amplifier 23, and the electrode 14*b* provided on the inner surface of the sensor cell unit 18 is grounded. A non-inverting input terminal of the differential amplifier 22 is connected to the source of the reference voltage 26, and a non-inverting input terminal of the differential amplifier 23 is connected to the source of the reference voltage 27. Output voltages of the sources of the reference voltage 26 and 27 are a voltage (0.4 V for example) corresponding to the stoichiometric air/fuel ratio. With the circuit construction described above, voltages appearing across the terminals of the current detection resistors 24 and 25 are supplied to the control circuit. Thus, pump currents $I_P$ (1) and $I_P$ (2) flowing through the variable resistors 24 and 25 are read by the air/fuel ratio control circuit 32. The differential amplifiers 22 and 23 are supplied with positive and negative power voltages.

To the air/fuel ratio control circuit 32, there are connected a throttle opening sensor 33 which comprises a potentiometer and generates an output voltage whose level corresponds to the opening of a throttle valve (not shown) of the engine, an absolute pressure sensor 34 provided in an intake pipe, on the downstream side of the throttle valve, and generating an output signal whose level corresponds to the absolute pressure in the intake pipe, a cooling water temperature sensor 35 for generating an output voltage whose level corresponds to the cooling water temperature of the engine, and a crank angle sensor 36 for generating a pulse train signal in synchronism with the rotation of the crankshaft of the engine.

The control circuit 32 includes various circuits such as an A/D converter 40 having differential inputs which selectively converts one of the voltages accross the terminals of the current detection resistors 24 and 25 to a digital signal, a level converting circuit 41 for performing the level conversion of the output signals of the throttle opening sensor 33, the absolute pressure sensor 34, and the water temperature sensor 35, a multiplexer 42 for selectively outputting one of the output signals of the sensors through the level converting circuit 41, an A/D converter 43 for converting the signal supplied from the multiplexer 42 into a digital signal, a waveform shaping circuit 44 for performing the waveform shaping of the output signal of the crank angle sensor 36 and outputting as a TDC signal, a counter 45 for detecting the period of the TDC signal by counting the number of clock pulses supplied from a clock pulse generating circuit (not shown), a drive circuit 46 for driving the solenoid valve 37, a CPU (central processing unit) 47 for executing digital operations according to programs, a ROM 48 in which various operation programs and data are previously stored, and a RAM 49. The A/D converters 40 and 43, the multiplexer 42, the counter 45, the drive circuit 46, the CPU 47, the ROM 48, and the RAM 49 are mutually connected by means of an input-/output bus 50. The solenoid valve 37 is provided in an air intake side secondary air supply passage (also not shown) leading to an intake manifold at a position downstream of a throttle valve of a carburettor of the engine.

Data indicative of one of pump currents $I_P(1)$ and $I_P(2)$ from the A/D converter 40, one of data of the throttle opening, the absolute pressure in the intake pipe, and the cooling water temperature from the A/D converter 43, and information of the engine rotational speed from the counter 45 are respectively supplied to the CPU 47 through the input/output bus 50. The CPU 47 executes an air/fuel ratio control routine in accordance with a clock pulse signal in the manner described later.

The air/fuel ratio control circuit 32 further controls the switching operation of the switch circuit 28, in such a manner that the drive circuit 38 drives the switch circuit 28 in accordance with a command from the CPU 47. In addition, to the heater elements 19 and 20, a heater current is supplied from the heater current supply circuit circuit 39 in accordance with a command from the CPU 47. By the heater element 19 and 20 operated in this way, the oxygen pump units 15 and 17, and the sensor cell units 16 and 18 are heated to a suitable temperature level which is higher than the temperature of the exhaust gas.

With the thus constructed oxygen concentration sensor, the exhaust gas in the exhaust pipe flows into the first gas retaining chamber 2 through the gas introduction hole 4 and is diffused therein. Also, the exhaust gas entered in the first gas retaining chamber 2 is introduced into the second gas retaining chamber 3 through the communication channel 5 and is diffused therein.

In the switch circuit 28, if the switch element 28*a* is positioned to connect the output terminal of the differential amplifier 22 to the current detection resistor 24 and the switch element 28*b* is positioned to open the line connecting the output terminal of the differential amplifier 23 and the current detection resistor 25 as illustrated in FIG. 3, the switch circuit 28 is in a position for selecting the first sensor.

Under this condition for selecting the first sensor, the output signal level of the differential amplifier 22 is in a positive level when the air/fuel ratio of the mixture is in a lean range. This positive level output voltage is supplied to the series circuit of the current detection resistor 24 and the first oxygen pump unit 15. Therefore, a pump current flows through the electrodes 11*a* and 11*b* of the first oxygen pump unit 15. Since this pump current flows from the electrode 11*a* to the electrode 11*b*, oxygen in the first gas retaining chamber 2 is ionized at the electrode 11*b* and moves through the oxygen pump unit 15 to the electrode 11*a*. At the electrode 11*a*, the oxygen is released in the form of oxygen gas. In this way, oxygen in the first gas retaining chamber 2 is pumped out.

By the pumping out of oxygen in the first gas retaining chamber 2, a difference in the oxygen concentration develops between the exhaust gas in the first gas retaining chamber 2 and a gas in the reference gas chamber 6. By this difference in the oxygen concentration, a voltage $V_s$ is generated across the electrodes 12*a* and 12*b* of the sensor cell unit 16. This voltage Vs is in turn supplied to the inverting input terminal of the differential amplifier 22. Therefore, the voltage of the output signal of the differential amplifier 22 becomes proportional to the differential voltage between the voltage $V_s$ and a voltage $Vr_l$ of the output signal of the source of the reference voltage 26. Thus, the magnitude of the pump current becomes proportional to the oxygen concentration in the exhaust gas.

Figure 4:
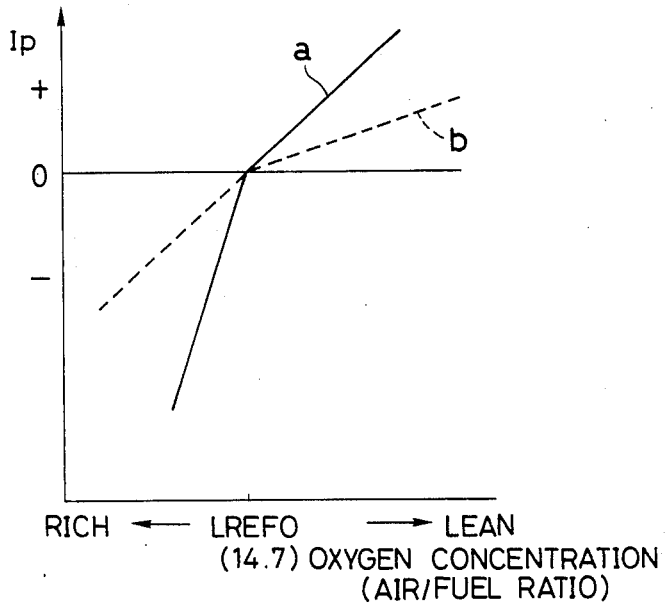
FIG. 4 is a diagram showing an output signal characteristic of the oxygen concentration sensor.

When the air/fuel ratio of the mixture is in a rich range, the voltage $V_s$ exceeds the output voltage $Vr_l$ of the source of the reference voltage 26. Therefore, the output signal level of the differential amplifier 22 turns from the positive level to the negative level. By this negative level, the pump current flowing across the electrodes 11*a* and 11*b* of the first oxygem pump unit 15 is reduced, to turn over the direction of the flow of the current. More specifically, the pump current will flow from the electrode 11*b* to the electrode 11*a*, so that the oxygen in the outside is ionized at the electrode 11*a* and in turn moves through the first oxygen pump unit 15 to the electrode 11*b*. At the electrode 11*b*, the oxygen is released in the form of oxygen gas into the first gas retaining chamber 2. In this way, the oxygen is pumped into the first gas retaining chamber 2. Therefore, the operation of the apparatus is such that the pump current is supplied so that the oxygen concentration in the first gas retaining chamber 2 is maintained constant, and the oxygen is pumped in or out according to the direction of the pump current. Therefore, the magnitude of the pump current and the output signal voltage of the differential amplifier 22 become proportional to the oxygen concentration in the exhaust gas in both of the lean and rich ranges. In FIG. 4, the solid line shows the magnitude of the pump current $I_P$.

On the other hand, the pump current $I_P$ is expressed by the following equation:

$$I_P = 4e\,\sigma o\,(Poexh - Pov) \ldots \quad (1)$$

in which e represents the electric charge, $\sigma o$ represents the diffusion coefficient of the gas introduction port 4 against the exhaust gas, Poexh represents the oxygen concentration of the exhaust gas, and Pov represents the oxygen concentration in the first gas retaining chamber 2.

The diffusion coefficient $\sigma o$ can be expressed by the following equation:

$$\sigma o = D \cdot A / kTl \ldots \quad (2)$$

where A represents the sectional area of the gas introduction port 4, k represents boltzmann's constant, T represents absolute temperature, l represents the length of the gas introduction port 4, and D represents a diffusion constant.

On the other hand, the second sensor is selected when the switch element 28*a* is positioned to open the line connecting the differential amplifier 22 and the current detection resistor 24, and the switch element 28*b* is positioned to connect the differential amplifier 23 to the current detection resistor 25.

In this state of selecting the second sensor, the pump current is supplied across the electrodes 13*a* and 13*b* of the second oxygen pump unit 17 so that the oxygen concentration in the second gas retaining chamber 3 is maintained constant by an operation the same as that in the state where the first sensor is selected. Thus, the oxygen is pumped in or out by the pump current and the magnitude of the pump current and the output signal of the differential amplifier 23 vary in proportion to the oxygen concentration both in the lean range and in the rich range.

In the state in which the second sensor is selected, the magnitude of the pump current can be expressed by using the equation (1) with the diffusion coefficient $\sigma o$ calculated for the gas introduction port 4 and the communication channel 5 also, and the oxygen concentration in the second gas retaining chamber 3 as the value Pov. On the other hand, it is recognized the magnitude of the pump current becomes small as the increase in a diffusion resistance which is inversely proportional to the diffusion coefficient $\sigma o$, both in the lean range and the rich range of the air/fuel ratio. This means that, when the second sensor is selected, the diffusion resistance becomes larger than that in the state where the first sensor is selected. Therefore, as shown by the dashed line b in FIG. 4, the magnitude of the pump current is smaller than that in the state where the first sensor is selected, both in the lean range and in the rich range.

Further, by selecting suitable size and length of the communication channel 5, the characteristic curve of the pump current with the second sensor in the rich range connects straightly to the characteristic curve of the pump current with the first sensor in the lean range, at a point where $I_P$ is zero ($I_P=0$). Thus, a characteristic curve of the pump current forming a straight line passing through the lean range and the rich range can be obtained by combining the first and second sensors. Also, with suitable control operation, characteristic curves of the output signals of the first and second differential amplifiers 22 and 23 can be connected straightly to each other at a point where the voltage level is equal to zero.

The operation of the control circuit 23 according to the present invention will be further explained as follows.

Figure 5A:
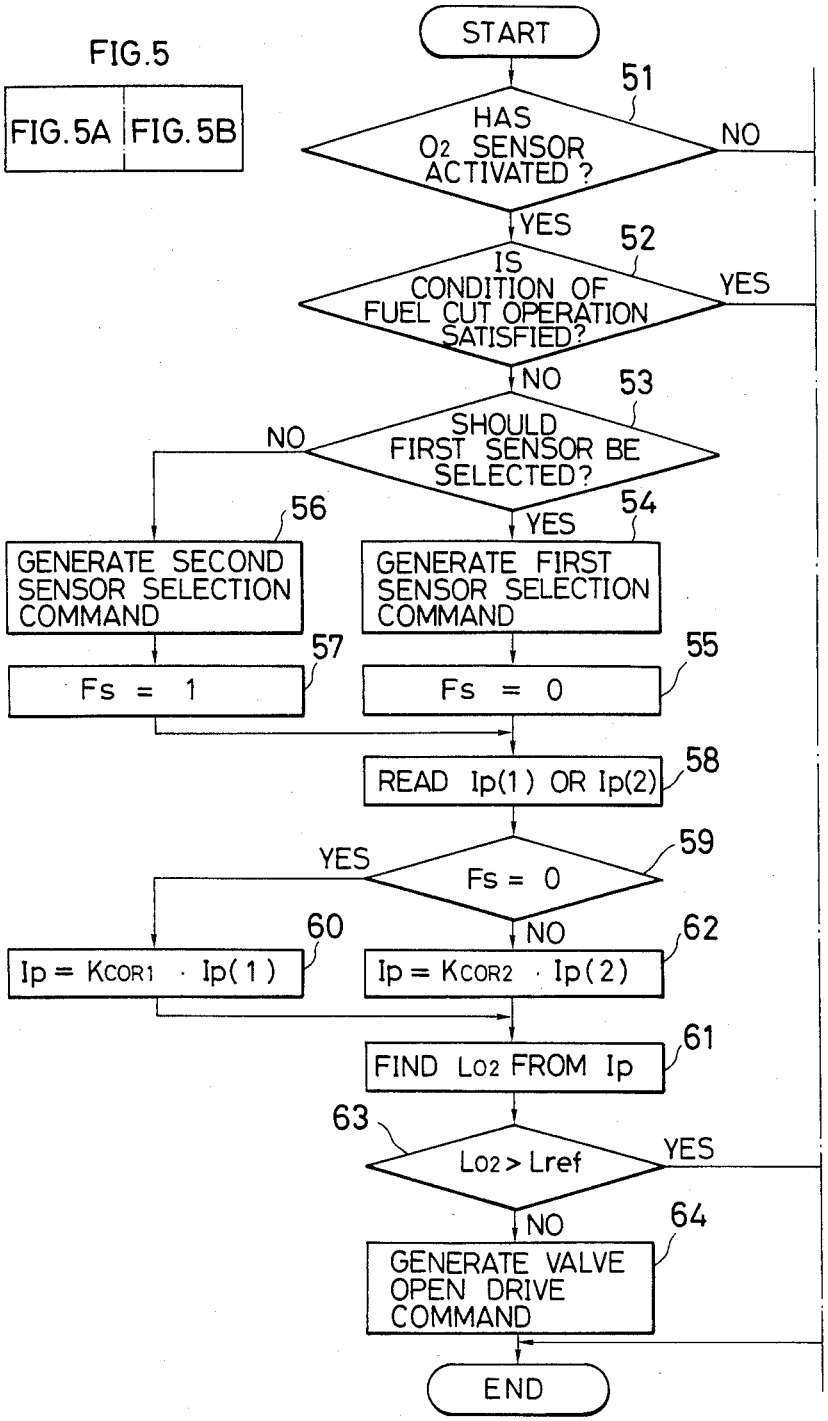
FIGS. 5A and 5B, when combined, are a flowchart showing the operation of the electronic control unit.
Figure 5B:
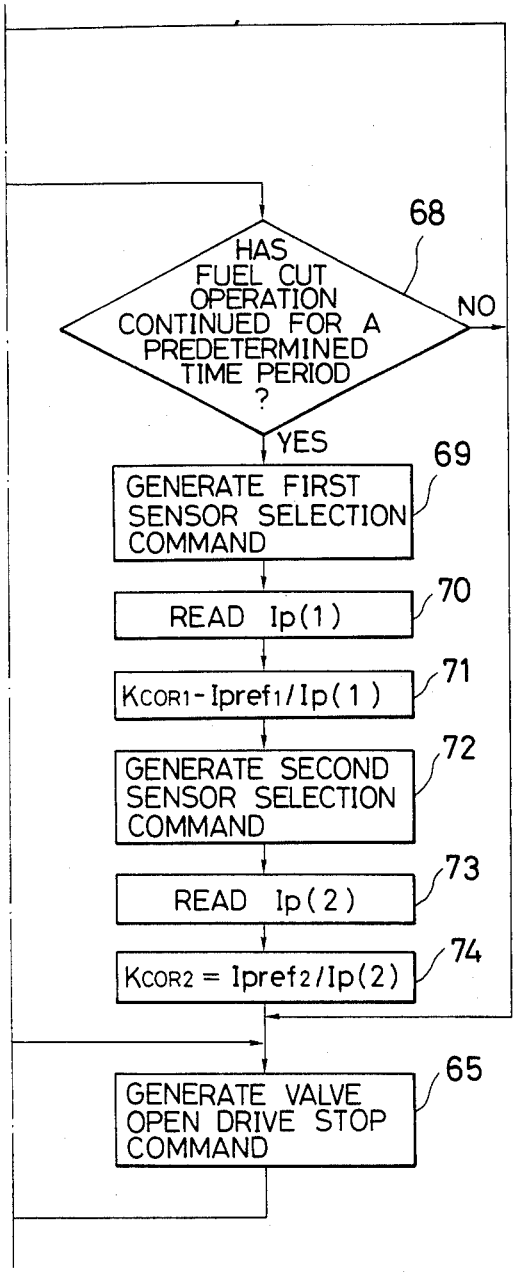

The CPU 47 executes an air/fuel ratio control routine shown in FIGS. 5A and 5B in accordance with the clock pulse. In this air/fuel ratio control routine, the CPU 47 at first determines whether or not the activation of the oxygen conecntration sensor has completed, at a step 51. The discrimination of the activation of the oxygen concentration sensor is performed, for example, on the basis of the temperature of the cooling water of the engine, the time period lapsed after the start of the engine, or the time period of the supply of the heater current to the heater elements 19 and 20. If the activation of the oxygen concentraction sensor is completed, whether or not a condition for the fuel cut operation is satisfied is detected at a step 52. The condition for the fuel cut operation is determined by in formation of the throttle opening and the engine rotational speed. When the throttle valve is substantially fully closed and the rotational speed of the engine is in a predetermined high speed region, the condition for the fuel cut operation is satisfied. If the condition for the fuel cut operation is not satisfied, discrimination as to which one of the first and second sensors should be selected is performed, at a step 53. This determination is performed in response to the engine operation or the controlled state of the air/fuel ratio. If it is determined that the first sensor should be selected, a first sensor selection command to the drive circuit 38, at a step 54. Then a value "0" is set for a flag Fs for indicating that the first sensor is selected, at a step 55. Conversely, if it is determined that the second sensor sould be selected, a second sensor selection command is supplied to the drive circuit 38, at a step 56. Then a value "1" is set for the flag Fs for indicating that the second sensor is selected, at a step 57. Then, a pump current value $I_P(1)$ or a pump current value $I_P(2)$ from the A/D converter 40 is read, at a step 58, and whether or not the flag Fs is "0" is detected at a step 59. If Fs=0, it indicates a state of the selection of the first sensor, and a correction coefficient $K_{COR1}$ is multiplied to the pump current value IP (1) read at the step 58, at a step 60, and a corresponding oxygen concentration detection value $L_{O2}$ is obtained at a step 61. If Fs=1, it indicates a state of the selection of the second sensor, and a correction coefficient $K_{COR2}$ is multiplied to the pump current value IP(2) read at the step 58, at a step 62, and a corresponding oxygen concentration detection value $L_{O2}$ is obtained at a step 61. Subsequently, whether or not the oxygen concentration detection value $L_{O2}$ is higher than a reference value Lref which corresponds to a target air/fuel ratio is detected, at a step 63. If $L_{O2} \leqq$ Lref, it means that the air/fuel ratio of the mixture supplied to the engine is rich. Therefore, a valve open drive command for opening the solenoid valve 37 is generated and supplied to the drive circuit 37, at a step 64. If $L_{O2}>$Lref, it means that the air/fuel ratio of the mixture is lean, and a valve open drive stop command for the solenoid valve 37 is generated and supplied to the drive circuit 46 at a step 65. In accordance with the valve open drive command, the drive circuit 46 opens the solenoid valve 37 to introduce the secondary air into the intake manifold of the engine, so that the air/fuel ratio of the mixture is made lean. Conversely, in response to the valve open drive stop command, the drive circuit 46 closes the solenoid valve 37, so that the air/fuel ratio of mixture is enriched. By executing these operations repeatedly at predetermined intervals, the air/fuel ratio of the mixture supplied to the engine is controlled to the target air/fuel ratio.

On the other hand, if the condition of fuel cut is satisfied, whether or not the state of satisfaction of the fuel cut condition has continued for more than a predetermined time period $T_l$ (20 seconds, for example) is detected at a step 68. This detection is performed by using, for example, a time counter in the CPU 47. If the state of satisfaction of the fuel cut condition has continued for more than the predetermined time period $T_l$, the first sensor selection command is supplied to the drive circuit 38 to select the first sensor, at a step 69. Then the pump current value $I_P(1)$ of the first sensor from the A/D converter 40 is read at a step 70. Further the correction coefficient $K_{COR1}$ corresponding to the pump current value $I_P(1)$ is calculated at a step 71. The correction coefficient $K_{COR1}$ is calculated by an equation of: $K_{COR1}=I_P\text{refl} / I_P(1)$, in which $I_P$refl represents a base pump current value of the first sensor under the fuel cut operation. Subsequently, the second sensor selection command is supplied to the drive circuit 38, to select the second sensor, at a step 72. Then the pump current value $I_P(2)$ of the second sensor issued from the A/D converter 40 is read at a step 73 and the correction value $K_{COR2}$ corresponding to the pump current value $I_P(2)$ at a step 74. The correction coefficient $K_{COR2}$ is calculated by an equation of: $K_{COR2}=I_P\text{ref2} / I_P(2)$, in which $I_P$ref2 represents a base pump current value of the second sensor under the fuel cut operation. The correction coefficients $K_{COR1}$ and $K_{COR2}$ are initialized to be equal to 1 upon turning-on of the ignition switch. In response to the first sensor selection command, the drive circuit 38 moves the switches 28*a* and 28*b* to the first sensor selection position described before, and such a driving state is maintained until the second sendor selection command is supplied from the CPU 47. On the other hand, in response to the second sensor selection command, the drive circuit 38 moves the switches 28*a* and 28*b* to the second sensor selection postion describe before, and such a driving state is maintained until the first sensor selection command is supplied from the CPU 47.

Figure 6:
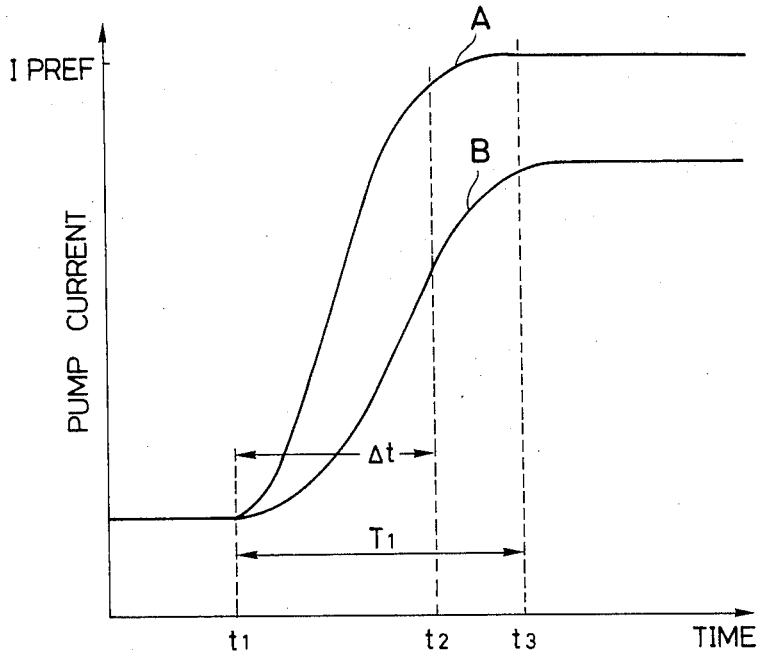
FIG. 6 is a diagram illustrating the change in the output signal of the oxygen concentration sensor after the start of a fuel cut operation.

In the above explained air/fuel ratio control system according to the present invention, if the operating state of the engine has changed from the normal operation to the fuel cut operation at a time point $t_1$ as shown in FIG. 6, the oxygen concentration in the exhaust pipe the engine gradually increases from that point of time. Therefore, if the output signal characteristic of the oxygen concentration sensor is a desirable characteristic, the pump current value increases as depicted by the solid lint A, and reaches the base pump current value $I_P$ref at a time point $t_3$ which is later than the time point $t_1$ by a predetermined time period $T_l$. On the other hand, if the output signal characteristic of the oxygen concentration sensor has been changed because of a reduction of the size of the gas introduction hole by the adhesion of oxide componds in the exhaust gas for example, the pump current increases, as depicted by the solid line B, more slowerly than the speed depicted by the solid line A, and reaches a stable level which is lower than the base pump current value $I_P$ ref. This difference corresponds to the change in the output signal characteristic of the oxygen concentration sensor, and the correction coefficients $K_{COR1}$ and $K_{COR2}$ corresponding to this difference are calculated.

Further, if it is assumed that the calculation values of the correction coefficients $K_{COR1}$ and $K_{COR2}$ become lower than a predetermined level when the operation of the oxygen concentration sensor is normal except for the change in the output signal characteristic, a fault of the oxygen concentration sensor can be detected from the calculation value of the correction coefficients $K_{COR1}$ and $K_{COR2}$.

Figures 7, 7A:
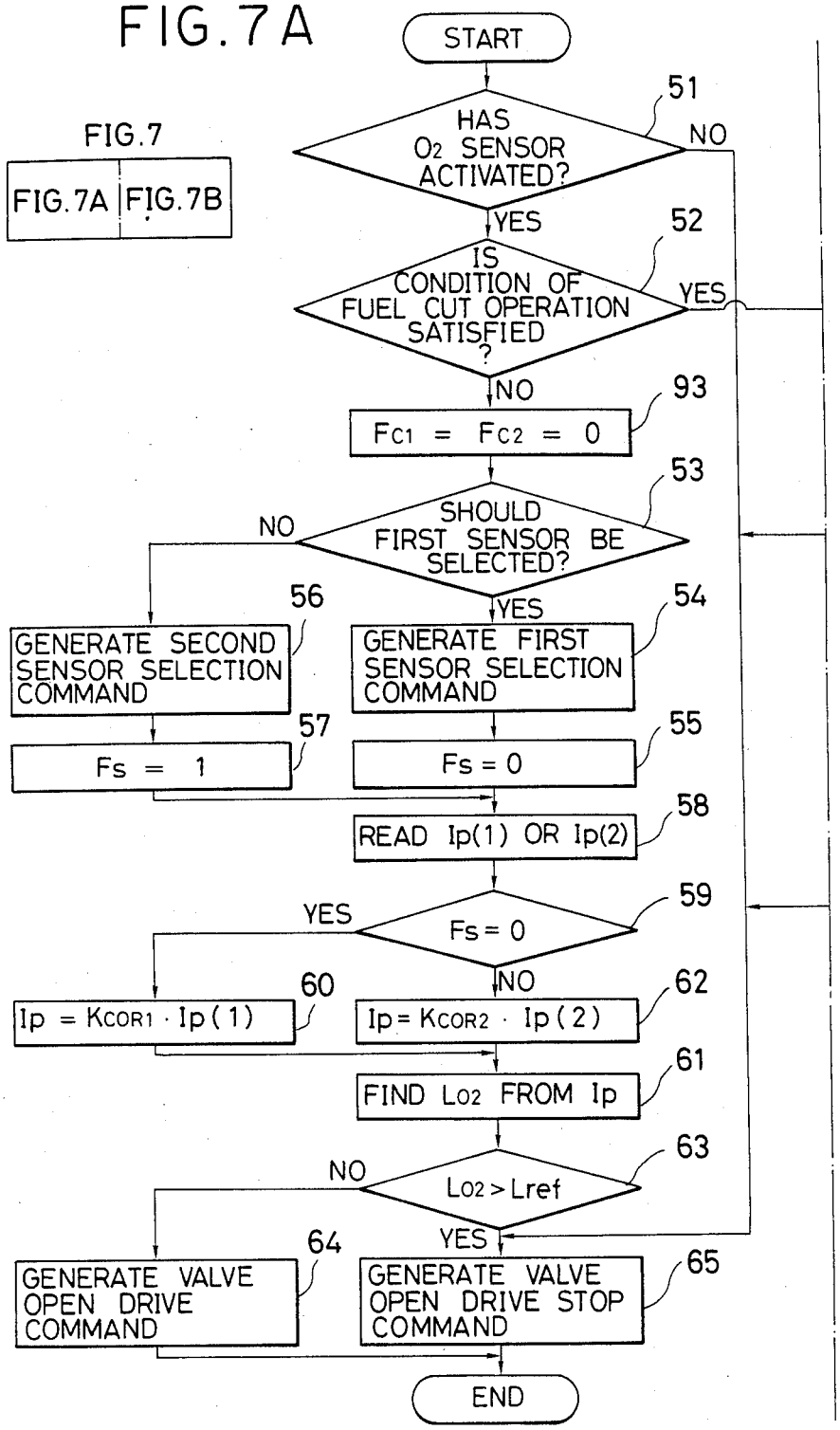

Referring to the air/fuel ratio control routine of FIGS. 7A and 7B, the second embodiment of the air/fuel ratio control system of the present invention will be explained hereinafter.

Since the operations of the steps 51 through 65 are the same as the first embodment, explanation thereof is omitted.

In this routine of detection and correction of the air/fuel ratio, the CPU 47 detects whether or not a flag $F_{C1}$ is equal to "0" at a step 75 when the condition of the fuel cut operation is satisfied. If $F_{C1}=0$, it means that the system is operating immediately after the start of the fuel cut operation, and the first sensor selection command is supplied to the drive circuit 38 to select the first sensor at a step 76, and the pump current value $I_P(1)$ of the first sensor issued from the A/D converter 40 is read and stored as $I_P(1)A$ at a step 77. Then the second sensor selection command is supplied to the drive circuit 38 to select the sensor sensor at a step 78, and the pump current value $I_P(2)$ of the second sensor is read, and stored as $I_P(2)A$ at a step 79. Then, a value "1" is set for the flag $F_{C1}$ at a step 80. Subsequently, whether or not the condition for the fuel cut operation is satisfied for more than a predetermined time period $\Delta t$ ($\Delta t<T_l$) is detected at a step 81. On the other hand, if $F_{C1}=1$, it means that the pump current values $I_P$ (1) and $I_P$ (2) immediately after the start of the fuel cut operation are read, and whether or not the flag $F_{C2}$ is equal to "1" is detected at a step 182. If $F_{C2}=1$, program proceeds to the step 65. If $F_{C2}=0$, it is determined that the condition for the fuel cut operation was not continued for more than the predetermined time $\Delta t$ at the previous execution of the main routine. Therefore, the operation or the step 81 will be executed immediately. If the condition for the fuel cut operation is satisfied for more than the predetermined time period $\Delta t$, the first sensor selection command is supplied to the drive circuit 38 to select the first sensor at a step 82, and the pump current value $I_P$ (1) of the first sensor issued from the A/D converter 40 is read and stored as $I_P$ (1)B at a step 83. Then, the second sensor selection command is supplied to the drive circuit 38 to select the sensor sensor at a step 84, and the pump current value $I_P$ (2) of the second sensor is read, and stored as $I_P(2)B$ at a step 85. Then, $I_P(1)A$ is subtracted from $I_P(1)B$ to obtain a calculated value $\Delta I_P(1)$ at a step 86. Then, whether or not the calculated value $\Delta I_P$ (1) is greater than the base value $\Delta I_P$ refl is detected at a step 87. If $\Delta I_P(1) \leqq \Delta I_P$ refl, it is determined that the output signal characteristic of the oxygen concentration sensor is changed, and a value of the correction coefficient $K_{COR1}$ corresponding to the absolute value $|\Delta I_P \text{refl} - \Delta I_P(1)|$ is searched out from a $K_{COR1}$ data map which is previously stored in the ROM 48, at a step 88. Similarly, $I_P(2)A$ is subtracted from $I_P$ (2)B to obtain a calculated value $\Delta I_P$ (2) at a step 89. Then, whether or not the calculated value $\Delta I_P$ (2) is greater than the base value $\Delta I_P$ref2 is detected at a step 90. If $\Delta I_P(2) \leqq \Delta I_P$ref2, it is determined that the output signal characteristic of the oxygen concentration sensor is changed, and a value of the correction coefficient $K_{COR2}$ corresponding to the absolute value $|\Delta I_P \text{ref2} - \Delta I_P(2)|$ is searched out from a $K_{COR2}$ data map which is previously stored in the ROM 48, at a step 91. Then, "1" is set for the flag $F_{C2}$ at a step 92. On the other hand, if $\Delta I_P(2) > \Delta I_P$ ref2, the operation of the step 92 will be executed immediately. The other steps in this embodiment is the same as the embodiment shown in FIGS. 5A and 5B except that a step 93 in which the flags $F_{C1}$ and $F_{C2}$ are made equal to "0" is executed if it is determined that the condition for the fuel cut operation is not satisfied, at the step 52.

As shown in FIG. 6, in the air/fuel ratio control system of the present invention explained so far, the width of the change of the pump current becomes small if the output signal characteristic of the oxygen concentration sensor has changed (as shown by the solid line B) with respect to the desired output characteristic (shown by the solid line A) at the time point $t_2$ predetermined time period $\Delta t$ after the time point $t_1$ at which the fuel cut operation is stated. Therefore, it can be determined that the output signal charateristic of the oxygen concentration sensor has changed when the width of the change of the pump current becomes smaller than the base value. Then the correction coefficients $K_{COR1}$ and $K_{COR2}$ are determined in accordance with the width of the change as explained above.

In the above described embodiments of the present invention, the firsr gas retaining chamber 2 communicates with the outside through the gas introduction hole 4, and the second gas retaining chamber 3 communicates with the first gas retaining chamber through the communication channel 5. The gas introduction hole 4 and the communication channel 5 may be, however, filled with a porous material such as alumina, so as to form a porous diffusion layer.

Further, in the above embodiments of the present invention, the air/fuel raito of the mixture is controlled to the target air/fuel ratio by controlling the supply of the secondary air in response to the output signals of the first and second sensors. However, this is not limitative, and the air/fuel ratio of the mixture may be controlled by adjusting the amount of fuel in response to the output signals of the first and second sensors.

It will be appreciated from the foregoing, in the air/fuel ratio control system according to the present invention, the correction value corresponding to the output signal value of the oxygen concentration sensor under the condition in which the fuel cut operation for stopping the fuel supply to the engine has continued for more than a predeterminmed time period. The sensor output signal value is correceted by the correction value during the operation other than the fuel cut operation. Therefore, the oxygen concentration in the exhaust gas, i.e. the air/fuel ratio of the mixture, can be detected accurately even if the output signal characteristic of the oxygen concentration sensor itself has changed from the deriable characteristic because of the reduction of the size of the gas introduction hole as a result of adhesion of oxide compounds, for example. Therefore, the accuracy of the air/fuel ratio feedback control can be improved by adjusting the air/fuel ratio of the mixture supplied to the engine in response to the corrected value of the output signal value of the oxygen concentration sensor.

What is claimed is:

1. An air/fuel ratio control system for an internal combustion engine having an exhaust gas passage, comprising:

an oxygen concentration sensor which includes, a sensing part forming a gas retaining space which communicates with an inside of said exhaust gas passage through a gas diffusion restriction region, and which includes a wall of oxygen ion conductive solid electrolyte member with two pairs of electrodes, each pair of which is disposed on opposing sides of said wall of oxygen ion conductive solid electrolyte member, and a sensor output signal generating part for supplying a current, in response to a voltage developping across said electrodes of one pair of said two pairs of electrodes, across said electrodes of the other pair of said two pairs of electrodes, and outputting a value of said current as said sensor output signal;

a correction value setting means for setting a correction value corresponding to said sensor output signal obtained when a fuel cut operation of said engine for stopping the supply of fuel to said engine has continued for more than a predetermined time period;

a correction means for correcting said sensor output signal in accordance with said correction value during an operation of said engine other than said fuel cut operation, and generating an output signal; and an air/fuel ratio adjusting means for adjusing an air/fuel ratio of the mixture to be suppied to said engine in response to said output signal of said correction means.

2. An air/fuel ratio control system as set forth in claim 1, wherein said sensing part of said oxygen concentration sensor further includes a second gas retaining space which communicates with said gas retaining space, and which includes a second wall portion of oxygen ion conductive solid electrolyte member with two second pairs of electrodes, each second pair of which is disposed on opposing sides of said second wall portion of oxygen ion conductive solid electrolyte member, and wherein said sensor output signal generating part alternatively supplies said current, in response to a voltage developping across said electrodes of one pair of said two pairs of electrodes or said two second pairs of electrodes, across said electrodes of the other pair of said two pairs of electrodes or said two second pairs of electrodes, and outputting a value of said current as said sensor output signal.

3. An air/fuel ratio control system as set forth in claim 1, wherein said correction value setting means calculates said correction value on the basis of a difference between said sensor output signal obtained immediately after the start of said fuel cut operation and said sensor output signal obtained when said fuel cut operation has continued for said predetermined time period.

4. An air/fuel ratio control system as set forth in claim 1, wherein said correction value setting means calculates said correctiuon value on the basis of a ratio between said sensor output signal obtained when the fuel cut operation has continued for more than the predetermined time period and a predetermined reference value.

5. An air/fuel ratio control system as set forth in claim 1, wherein said correction value setting means establish said correction value only when a difference between said sensor output signal obtained immediately after the start of said fuel cut operation and said sensor output signal obtained when said fuel cut operation has continued for said predetermined time period becomes equal to or smaller than a predetermined reference level.

* * * * *